United States Patent [19]

Properzi

[11] 4,044,586

[45] Aug. 30, 1977

[54] CONTINUOUS ROLLING MILL

[76] Inventor: Giulio Properzi, Via Pietro Cossa, 1, Milan, Italy

[21] Appl. No.: 610,817

[22] Filed: Sept. 5, 1975

[30] Foreign Application Priority Data

Sept. 20, 1974 Italy ..... 27526/74

[51] Int. Cl.[2] ..... B21B 1/04; B21B 27/02

[52] U.S. Cl. ..... 72/224; 72/234; 29/527.7; 164/76

[58] Field of Search ..... 72/224, 234, 235; 29/527.7; 164/87, 76, 270

[56] References Cited

U.S. PATENT DOCUMENTS

| | | | |
|---|---|---|---|
| 3,517,537 | 6/1976 | Cofer | 72/234 |
| 3,561,105 | 2/1971 | Cofer | 164/76 X |
| 3,618,354 | 11/1971 | Bindernagel et al. | 72/224 |

*Primary Examiner*—Milton S. Mehr

*Attorney, Agent, or Firm*—Albert Josif; Guido Modiano

[57] ABSTRACT

There is disclosed a rolling assembly for the initial rolling passes of a metal ingot coming from a continuous casting machine and having substantially triangular or trapezial cross-section with mutually proportional sides. The rolling assembly comprises at least a first rolling unit with three rolls each having the same geometrical shape defining a substantially circular passage. This shape is such that the metal ingot entering the rolling unit comes into contact along a preponderal part of its peripheral contour with the rolls and that the forces acting on the metal ingot have at each point of contact a resultant substantially directed towards the center of the metal ingot.

5 Claims, 8 Drawing Figures

CONTINUOUS ROLLING MILL

BACKGROUND OF THE INVENTION

This invention relates to a continuous rolling mill, in particular a rolling mill having rolling units with three rolls for accomplishing the initial rolling passes on an ingot originating from a continuous casting machine of the wheel and band type.

The geometry and shape of the cross-section of an ingot leaving a machine of this type is determined substantially by two factors. Firstly, it has an upper face which is necessarily flat in that it is formed in contact with the metal band which in these machines closes the groove in the casting wheel over a certain arc, and secondly it comprises two lateral faces formed in contact with the lateral walls of the casting groove, which of necessity form a draft angle with the normal to the upper flat face to enable the ingot to leave the casting wheel.

The draft angle, normally 8°, cannot be varied to any sensible extent, and the only freedom remaining to the designer who wishes to modify the cross-section of the ingot in any way in order to better adapt it to the rolling requirements to which the ingot will be subjected is to vary the height/width ratio of the cross-section and the more or less rounded shape of the part opposite the flat face, which shape reproduces the shape of the bottom of the casting groove.

In rolling these ingots in relation to the particular shape of their cross-section, various methods have been proposed for the initial rolling passes. The most known and widespread methods are those which use rolling units having three rolls disposed at 120° to each other and defining a passage substantially in the shape of a flat sided hexagon or triangle, or a passage obtained by combining the two latter.

In the first case the rolls comprise a groove having a cross-section consisting of straight lengths disposed at approximately 120° to each other and converging towards the middle, where they are joined together to form the groove base. The two lengths define substantially two sides of the hexagonal passage, the other sides being formed respectively by the contours of the grooves of the other two rolls. In the second case the rolls are absolutely free from any rolling groove and have a perfectly cylindrical geometrical shape, the lateral surfaces of the rolls defining the rolling surface. In the third case two rolls of the first type and one of the second type are used in practice.

All these methods, though to different extents, create in the recently molten ingot material slip towards the free space between one roll and another, this slip being sufficient to create cracks in the case of certain metals, such as copper, at the accumulation areas formed between the rolls. Furthermore, these methods are not able to eliminate the small central holes which may form or are formed in casting certain alloys, such as aluminium alloys, e.g. aluminium-magnesium alloys.

SUMMARY OF THE INVENTION

The object of the present invention is to provide a rolling assembly particularly suitable for the initial rolling passes, which does not lead to the mentioned defects, i.e. in particular the formation of cracks, and which is also able to reconstitute the integrity of an ingot which comprises a hole in its central area.

This object is attained according to the invention by a continuous rolling mill of the type initially specified, comprising at least a first rolling unit with three rolls each having rolling grooves of equal geometry such that they contact the ingot about a preponderant part of its cross-section and generate on the ingot, substantially along the entire portion of the cross-section in contact with the rolls, forces which at each point have a resultant directed substantially towards the centre of the ingot.

A preferred embodiment particularly suitable for a substantially triangular ingot is that in which the grooves are shaped as arcs of a circle to define a circular passage of constant radius, such that the surface untouched by the rolls after passage is not greater than approximately 15% of the surface touched by the rolls.

A further advantageous embodiment is that in which the three rolls each comprise a rolling groove having a central arcuate portion and two adjacent arcuate portions, the radius of said central portion being greater than that of said adjacent portions.

A rolling assembly with rolls formed in accordance with the invention enables cracks in the spaces between one roll and another to be eliminated, in that the forces tangential to the groove contour and responsible for material slip towards the space between the rolls are eliminated or strongly diminished by the continuous curvature of the groove contour, while at each point the forces substantially orthogonal to the contour have greater consistency, such that at each point a resultant arises which is virtually directed towards the rolling axis. In particular, when the groove has a central portion of larger radius than the adjacent peripheral portions, the greater curvature of these latter portions, i.e. their smaller radius, creates an effective action hindering slip precisely at those points at which it usually occurs most easily, and avoids any crack formation. The resultant which substantially at each point of the contour is directed virtually towards the centre of the ingot favours compression of the ingot from all sides, so urging the material towards the rolling axis with consequent elimination of any hole present there.

It is advantageously possible to conceive a continuous multistand rolling mill in which some rolling stands configurated in accordance with the invention are alternated with stands defining for example a circular or elliptically curved triangle. This alternation may be advantageously pursued until the complete destruction of the dendritic structure of the cast metal in the metal being rolled, or the complete disappearance of the central bore.

BRIEF DESCRIPTION OF THE DRAWINGS

Further details of the invention will be more evident from the description given hereinafter by way of example of some preferred embodiments of the invention, illustrated in the accompanying drawings in which.

DESCRIPTION OF THE PREFERRED EMBODIMENTS

Figure 1:
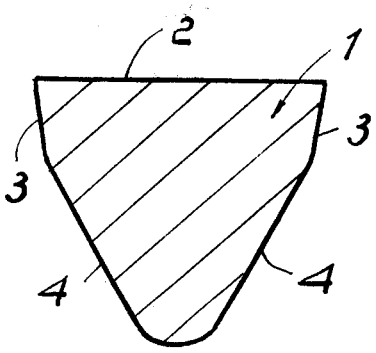
FIGS. 1, 2 and 3 show some typical cross-sections of ingots obtained by a continuous casting machine of the wheel and band type, and intended for rolling.
Figure 2:
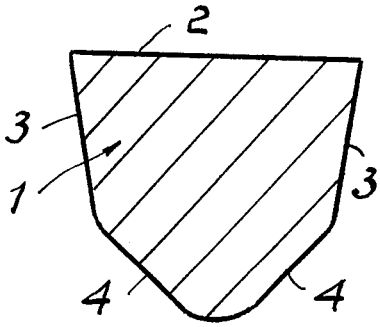
Figure 3:
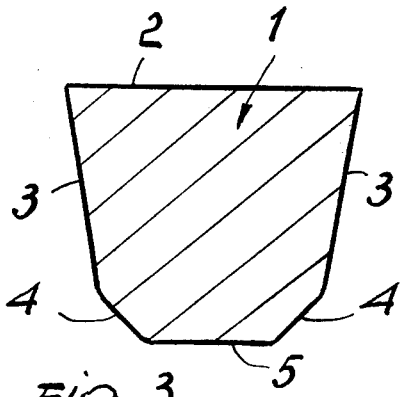

The continuous ingot 1 leaving the wheel and band casting machine comprises generally a flat face 2 generated by contact with the metal band covering the casting wheel groove, two lateral faces 3 forming a draft angle with the normal to the face 2 and generated by contact with the lateral walls of the casting wheel groove, and two further faces 4 which are more inclined and joined together (or joined by a further flat face 5 in the case of FIG. 3). The resultant cross-section is thus substantially triangular or trapezial with sides mutually proportional (FIGS. 1 - 3).

Figure 4:
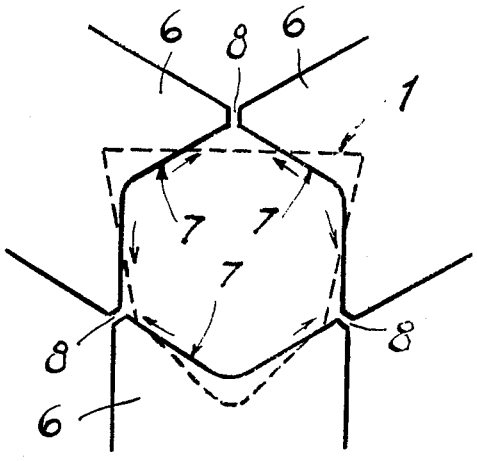
Fig. 4 PRIOR ART
FIGS. 4, 5 and 6 show the types of passage at present mostly used for rolling ingots originating from a casting wheel.
Figure 5:
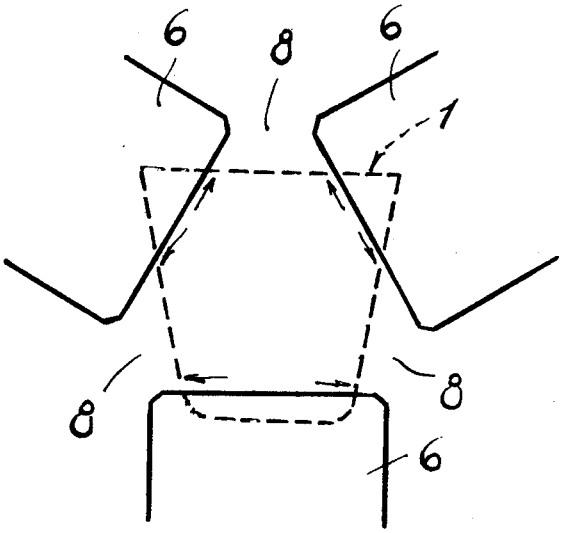
Fig. 5 PRIOR ART
Figure 6:
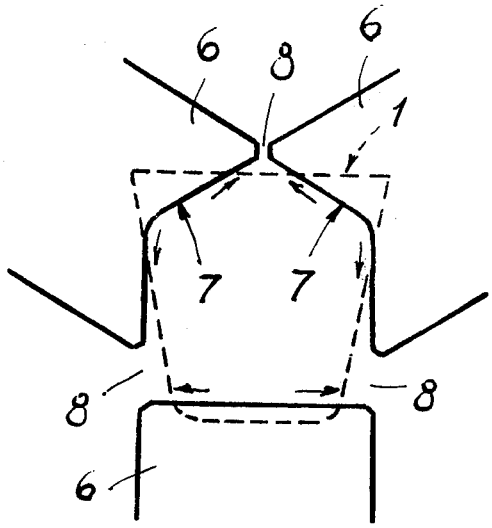
Fig. 6 PRIOR ART

An ingot of this type is rolled in accordance with present practice by rolling stands comprising three rolls disposed at 120° to each other and mainly defining a passage cross-section as shown in FIGS. 4 to 6. In all these cases the hot material which is deformed by the rolls 6 undergoes movement (indicated by the arrows) substantially parallel or tangential to the contour of the groove 7 of the respective rolls and tends to slip along the straight portions of the groove contour towards the space 8 between one roll and another. At these points, the hot compressed material is subjected to expansion and curvature, and this easily induces cracks which cannot further be eliminated. The phenomenon is easy to understand if the embodiment shown in FIGS. 5 and 6 is considered, in which there is ample space 8 between one roll and another, but it is also not absent in the embodiment shown in FIG. 4.

According to the invention, the three rolls 9 comprise grooves 10 identical to each other and shaped in such a manner as to embrace the ingot 1 about a preponderant part of its cross-section and produce on the ingot, over the entire portion of the section in contact with the rolls, forces which at every point have a resultant directed substantially towards the middle of the ingot.

Figure 7:
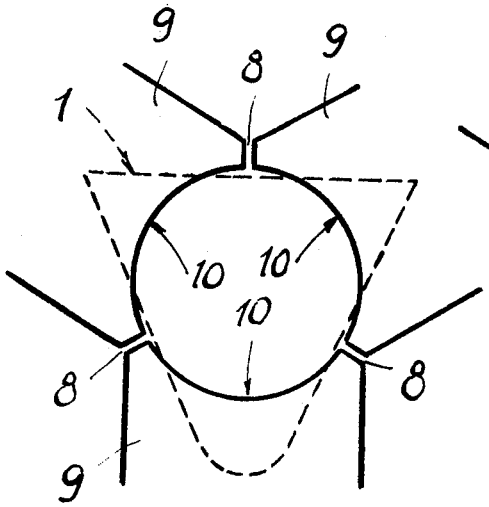
FIGS. 7 and 8 show two passage shapes formed in accordance with the present invention.

In a first embodiment shown in FIG. 7, the rolls 9, disposed at 120°, each have a groove 10 in the form of an arc of a circle, which in the roll assembly define a perfectly circular passage cross-section, with the elimination of all straight portions in the groove contour. It is preferable and particularly advantageous if each roll embraces an equal part of the cross-section of the ingot, and the part which has not been embraced after passage is not greater than 15% of the embraced part. With the embodiment shown in FIG. 7, each part of the cross-section of the metal in contact with the rolls 9 undergoes a thrust which is virtually directed towards the middle of the ingot. The curvature prevents any attempt at tangential slip of the material. The circular shape is particularly suitable for substantially triangular ingots.

Figure 8:
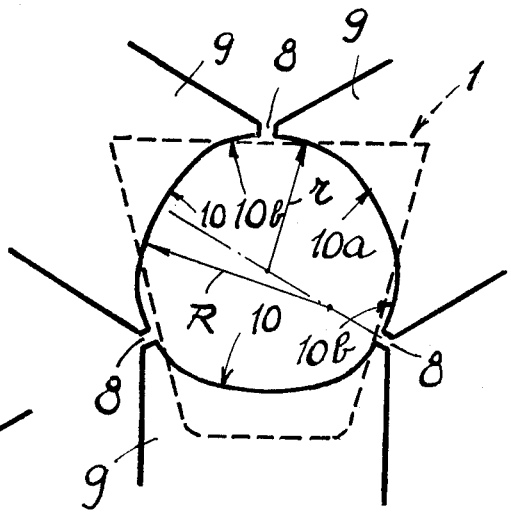

In a second embodiment of the invention, shown in FIG. 8, the three rolls 9, disposed at 120°, each comprise a groove 10 of curved shape with a central portion **10*a* forming the groove base having a radius R substantially greater than that of the two portions 10*b*** adjacent to it of radius *r*, which effectively prevent slip towards the interspace 8 between the rolls. In this case the action of the rolling forces is also directed prevalently towards the middle of the ingot, with the re-establishment of the integrity of the metal in its central region due to the general compression action from all sides.

One or other of the described rolling assemblies, or both, or others configurated in accordance with the invention, may be alternated in a multi-stand rolling mill with assemblies comprising circular or elliptical curved triangular passages. Numerous such assemblies may be disposed alternately until the dendritic structure of the metal being rolled is completely destroyed, or the central bore has completely disappeared.

The invention has been described with particular reference to rolling ingots originating from a continuous casting machine of the wheel and band type, but it may also be advantageously applied to the rolling of other forms of ingots.

I claim:

1. A continuous rolling mill having rolling units with three rolls for rolling an ingot originating from a continuous casting machine of the wheel and band type, said ingot having a substantially triangular or trapezial cross-section of mutually proportional sides, the rolling mill comprising at least a first rolling unit with three rolls each having rolling grooves of equal geometry configured as an arc of a circle, to define a substantially circular passage dimensioned so that a surface portion of the ingot is untouched by the rolls during rolling, this surface portion being not greater than approximately 15% of the surface touched by the rolls.

2. A rolling mill as claimed in claim 1, particularly for rolling an ingot of substantially triangular cross-section, wherein the rolls at least of the first rolling unit have rolling grooves defining a circular passage of constant radius.

3. A rolling mill as claimed in claim 1, wherein the rolls at least of the first rolling unit each have a rolling groove with an arcuate central portion and two adjacent arcuate portions, the radius of said central portion being greater than that of said adjacent portions.

4. A rolling mill as claimed in claim 2, comprising a plurality of rolling units with rolls having grooves in the form of arcs of a circle of constant radius defining a circular passage, alternating with rolling units having rolls prefereably defining a passage in the form of a circular or elliptically curved triangle.

5. A rolling mill as claimed in claim 3, comprising a plurality of rolling units with rolls having rolling grooves configured with a central arcuate portion of radius substantially greater than that of the two adjacent arcuate portions, alternating with rolling units having rolls preferably forming a passage in the form of a circular or elliptically curved triangle.

* * * * *